US005624385A

United States Patent [19]

Hwang

[11] Patent Number: 5,624,385

[45] Date of Patent: Apr. 29, 1997

[54] MASSAGING/SKIN-SCRAPING ROD FOR TRAVELLER

[76] Inventor: Shih M. Hwang, 17811 Sky Park Cir., Suite D&E, Irvine, Calif. 92714

[21] Appl. No.: 507,679

[22] Filed: Jul. 25, 1995

[51] Int. Cl.[6] ..... A61H 7/00

[52] U.S. Cl. ..... 601/135; 601/137; 606/204

[58] Field of Search ..... 601/107, 134–138; 606/204, 237, 238, 201

[56] References Cited

U.S. PATENT DOCUMENTS

| | | | |
|---|---|---|---|
| 1,212,443 | 1/1917 | Blaine | 601/137 |
| 1,965,861 | 7/1934 | Schneider | 601/137 X |
| 4,483,328 | 11/1984 | Wolocko | 601/135 |
| 4,590,926 | 5/1986 | Courtin | 601/134 X |
| 4,632,095 | 12/1986 | Libin | 601/135 |
| 4,705,030 | 11/1987 | Tepperberg | 601/134 X |
| 5,382,222 | 1/1995 | Yih-Jong | 601/135 |

FOREIGN PATENT DOCUMENTS

| | | | |
|---|---|---|---|
| 2606633 | 5/1988 | France | 601/134 |

*Primary Examiner*—Robert A. Hafer
*Assistant Examiner*—Brian E. Hanlon
*Attorney, Agent, or Firm*—Pro-Techtor International

[57] ABSTRACT

A massaging rod that is generally Y-shaped with an ellipse end portion at a first end. One side of said ellipse end has a bossed tip and the opposite side has a mallet shape. The opposing end of the rod forms a fork-shape. The first tip of the fork-shaped end has a claw-shape configuration and the second tip is circular. A projected stem member having a circular end is provided at the center of the body. The periphery of the body is rounded to provide a sound massaging effect.

1 Claim, 2 Drawing Sheets

MASSAGING/SKIN-SCRAPING ROD FOR TRAVELLER

BACKGROUND OF THE INVENTION

1. Field of the Invention

This invention relates to massaging equipment, and more particularly, is a massaging/skin-scraping rod for travellers.

2. Description of the Prior Art

In Taiwan Utility Patent Application Number 80210325, the inventor disclosed a massaging rod suitable for a traveller. This massaging rod generally has a triangular shape with recessed circular sides. Each of the three tips has a preset size for contacting acupuncture points. In the middle position, there is a large sized rounded corner for providing a positive massage to an acupuncture point. In addition, the large sized corner is also suitable for massaging the reacting area located at the foot.

Even though this massaging rod provides a massaging effect to the acupuncture points, it is still considered to have some disadvantages. Since each of the three corners has the same configuration, each provides the same massaging effect to the acupuncture points. Besides, based on its shape and size, it cannot be applied to the acupuncture points on the fingers. Above all, this conventional massaging rod is not convenient. It is made from two pieces, which not only complicates the manufacturing procedure, but is also not attractive.

SUMMARY OF THE INVENTION

It is the object of this invention to provide a massaging rod for travellers which is multi-functional, being used for acupuncture, finger-press, skin-scraping, and muscle relaxation. It is handy, portable and provides service at any time.

The massaging rod made according to this invention is generally Y-shaped with an ellipse end portion at a first end. One side of said ellipse end has a bossed tip and the opposite side has a mallet shape. The opposing end of the rod forms a fork-shape. The first leg of the fork shaped end has a claw-shape tip configuration and the second leg's tip is circular. A projected stem member having a circular end is provided at the center of the body. The periphery of the body is rounded to provide a sound massaging effect.

BRIEF DESCRIPTION OF THE DRAWINGS

The drawings disclose an illustrative embodiment of the present invention to exemplify the various advantages and objects hereof, and are as follows.

DETAILED DESCRIPTION OF THE PREFERRED EMBODIMENT

Figure 1:
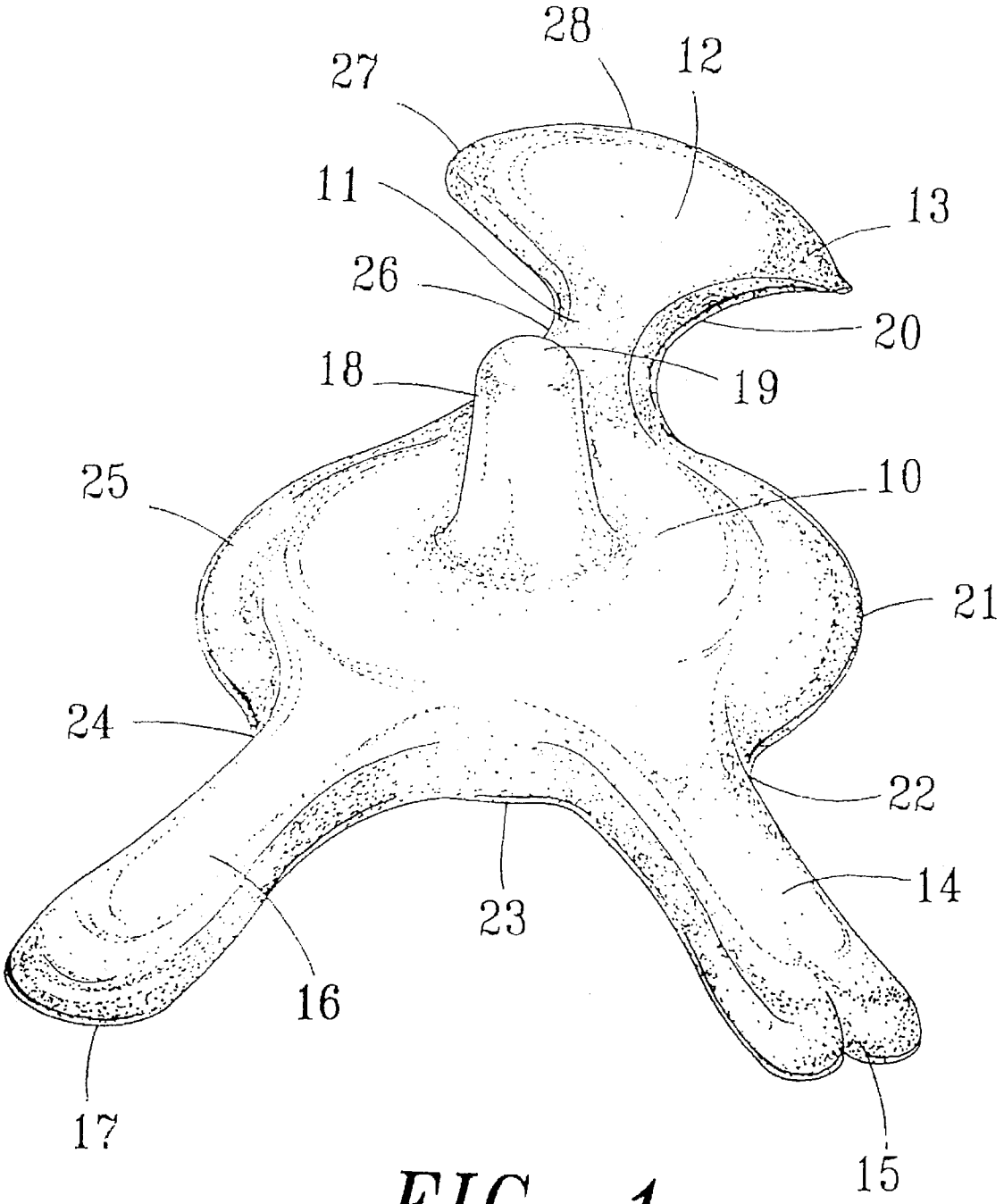
FIG. 1 is a perspective view of the massaging rod made according to this invention.
Figure 2:
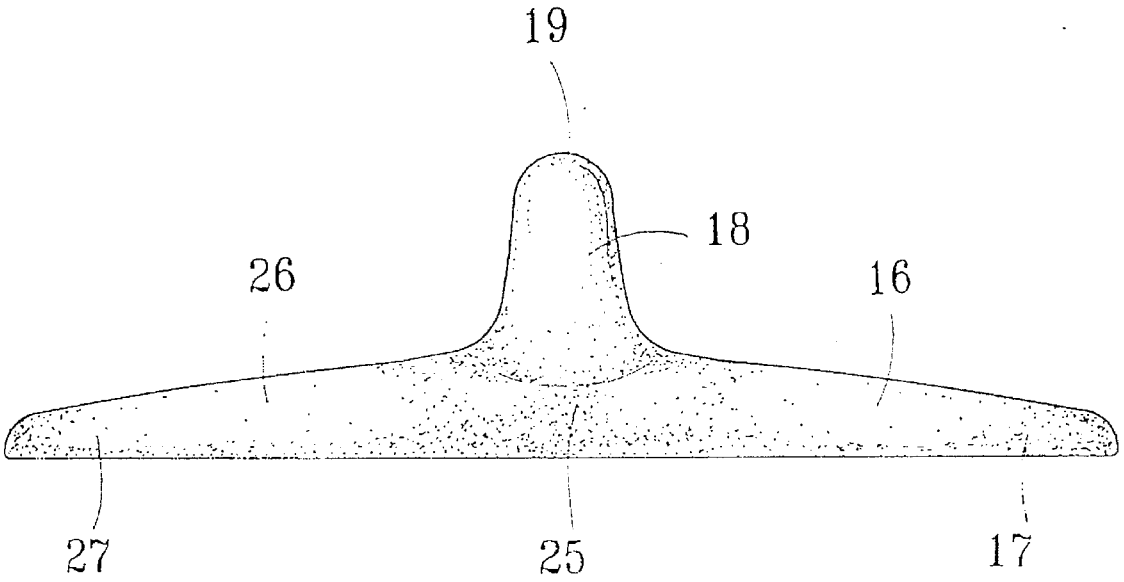
FIG. 2 is a left side elevational view of the massaging rod taken from FIG. 1.

As shown in FIGS. 1 and 2, the massaging rod made according to this invention has a main body that is generally Y-shaped and is made with a one-piece configuration. The massaging rod generally includes a central body 10 having a circular configuration. The central body 10 has an elongated portion 11 including an ellipse end 12. A neck portion is defined between the ellipse end 12 and the body 10. The sides of said neck are formed with different contours 20, 26. One side of said ellipse end has a projected boss 13. The opposite side of said ellipse end 12 has a mallet portion 27.

At the opposite end of said central body 10 is a forked end which includes: a first leg 14 and a second leg 16. The first leg 14 has a claw-shaped projection 15 and the second leg 16 has a circular end 17. A contour area 23 is defined between said first leg 14 and the second leg 16. A first contour 21 with a large curvature is formed between said first leg 14 and said elongated end 11 via a first recessed portion 22. The area between the second leg 16 and the elongated end 11 has a second contour 25 having a smaller curvature via a recessed portion 24. A projected stem member 18 having a rounded end 19 is provided at the center of the body 10. On the other hand, the periphery of said body 10 is rounded with a flat edge which provides smooth contact with the skin. In light of this, the massaging rod made according to this invention can be utilized to provide an acupuncture effect, finger press effect, skin-scraping effect, and muscle relaxation effect. Furthermore, the central body 10 is very hard, in that it can be used to slap, knock and pound skin.

Now, a description will be made of the different uses of the massaging rod.

1. The user of the massaging rod holds the body 19 and uses the boss 13 to press an acupuncture point to get an acupuncture effect. The user can readily use it during the travelling.

2. The user can use the mallet portion 27 to perform a massage.

3. The user can use the contour 28 of the ellipse 12 of the elongate end 11 to perform a massage of the human body. When the user conducts the above three applications, the massaging rod can be firmly and readily held by the contours 20, 26.

4. By moving the first leg 14, the claw portion 15 of the first leg 14 will provide excellent massage effects due to its double finger shape. This is the original aim of this unique design, The effects produced by the claw portion 15 and the ones produces by a conventional massager rod are not at all similar.

5. The user can use the second contour 25 to perform a massage or skin scraping on the forearm, leg, back and foot.

6. The user can use the first contour 21 to perform the massage or skin scraping on the forearm, leg, back and foot.

7. The user can use the second leg 16 to conduct a deeper massage to any part that so requires, or to relax the muscles. Both the acupuncture points and the veins can be massaged. The second leg 16 can also be applied on the finger, but the results are less efficient. A better effect can be reached on thicker skin area.

8. The user can also use the semi-spherical end 19 of the stem 18 to simulate a finger press to the forearm, head, face, neck, back, leg, foot, palm and finger. The results are similar to those obtained by finger massage.

9. The contour 23 disposed between the legs 14 and 16 can also be applied to massage the finger, forearm and hand.

10. The first recessed portion 22 and second recessed portion 24 or the contours 20 and 26 of the elongate end 11 can be utilized to conduct the massage to the fingers.

Since each part of the massaging rod made according to this invention has an intended function, no doubt the overall features of the massaging rod made according to this invention are far better than the conventional massager rod which has only one feature. In addition, the outline of the massaging rod is aesthetically pleasing. Further, the massaging rod is made with a one piece configuration which provides durability. The massaging rod is made from resilient materials, preventing it from being easily broken.

Many changes and modifications in the above described embodiment of the invention can, of course, be carried out without departing from the scope thereof. Accordingly, to promote progress in science and the useful arts, the invention disclosed is intended to be limited only by the scope of the appended claims.

What is claimed is:

1. A massaging rod comprising:

a main body that is generally Y-shaped, said main body includes a circular central body, an elongated portion including an ellipse end extends from a first side of said central body, a neck portion of said elongated portion includes two sides, each having a different contour, a first side of said ellipse end includes a projected boss, and a second side of said ellipse end includes a mallet portion, a forked end extends from a second side of said central body, said forked end includes a first leg and a second leg, said first leg of said forked end includes a claw-shaped projection, while said second leg of said forked end is circular, a first contoured area is defined between said first and second legs of said forked end, a second contoured area is defined between said first leg of said forked end and said elongated portion, and a third contoured area is defined between said second leg of said forked end and said elongated portion, each of said contoured areas having a different contour, said central body includes a stem member with a rounded end, said stem member projects upward from a center portion of said central body, said central body includes a rounded periphery and a bottom side which is flat to facilitate scraping of a user's skin.

* * * * *